United States Patent [19]

Mailloux

[11] 4,246,585

[45] Jan. 20, 1981

[54] SUBARRAY PATTERN CONTROL AND NULL STEERING FOR SUBARRAY ANTENNA SYSTEMS

[75] Inventor: Robert J. Mailloux, Wayland, Mass.

[73] Assignee: The United States of America as represented by the Secretary of the Air Force, Washington, D.C.

[21] Appl. No.: 73,584

[22] Filed: Sep. 7, 1979

[51] Int. Cl.[3] ..... H01Q 3/28; H01Q 3/46

[52] U.S. Cl. ..... 343/854; 343/754

[58] Field of Search ..... 343/778, 853, 854, 754, 343/100 SA

[56] References Cited

U.S. PATENT DOCUMENTS

| | | | |
|---|---|---|---|
| 3,245,081 | 4/1966 | McFarland | 343/854 |
| 3,911,442 | 10/1975 | Hatch | 343/854 |
| 3,997,900 | 12/1976 | Chin et al. | 343/854 |
| 4,124,852 | 11/1978 | Steudel | 343/854 |
| 4,166,274 | 8/1979 | Reudink | 343/854 |

OTHER PUBLICATIONS

Chapman, Adaptive Arrays and Sidelobe Cancellers, Microwave Journal, Aug. 1977, pp. 43–46.

Tang, Survey of Time-Delay Beem Steering Techniques, Proceedings of the 1970 Phased Array Antennas Symposium, Artech House Inc. pp.254–260.

*Primary Examiner*—Eli Lieberman

*Attorney, Agent, or Firm*—Donald J. Singer; Willard R. Matthews, Jr.

[57] ABSTRACT

Improved performance of an electronically scanned subarray antenna system is realized by tailoring the subarray pattern in a manner that reduces the undesirable effects of illumination truncation at the edge of the main array. This is accomplished by introducing variable attenuators into individual feed elements to effect an illumination intensity taper of the feed element array output. The improvement permits effective utilization of deterministic and adaptive nulling at both the main array and the subarray levels and further provides a system ability to scan over wide spatial angles with wide bandwidths and low sidelobes. The technique is adaptable to both space fed and constrained subarray antenna systems.

9 Claims, 15 Drawing Figures

FIG. 6
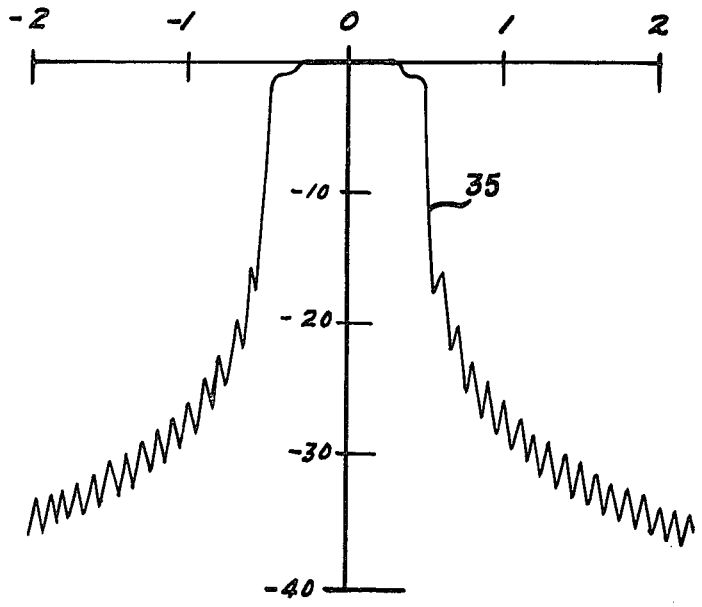
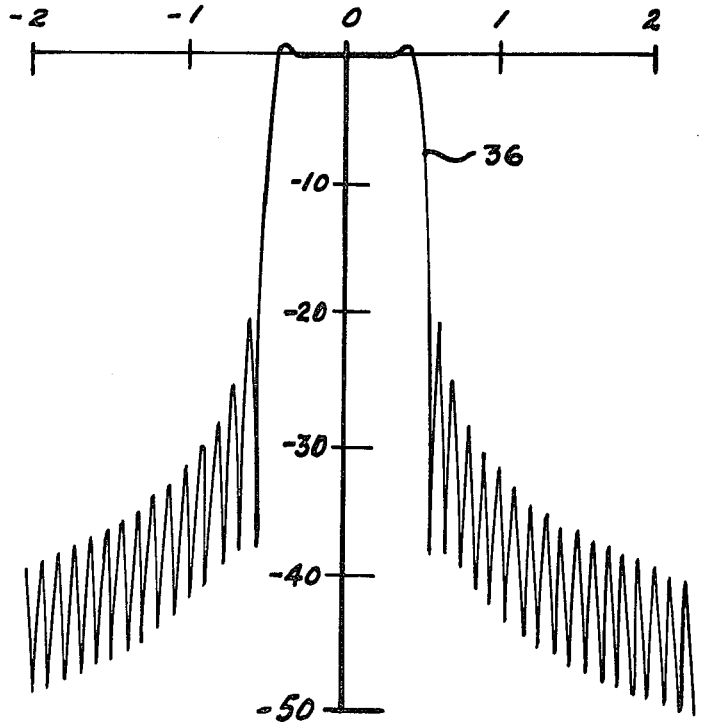
FIG. 7

SUBARRAY PATTERN CONTROL AND NULL STEERING FOR SUBARRAY ANTENNA SYSTEMS

STATEMENT OF GOVERNMENT INTEREST

The invention described herein may be manufactured and used by or for the Government for governmental purposes without the payment of any royalty thereon.

BACKGROUND OF THE INVENTION

This invention relates to subarray antenna systems and in particular to subarray pattern control and null steering improvements in such systems.

A growing number of military radar systems require wideband scanning arrays with sidelobes below −40 dB, steered nulls, and other forms of active pattern control. Since the cost of a fully time delay steered array is prohibitive for many of these applications there is a need for subarraying feeds so that the time delay and/or null steering can be controlled at the relatively fewer subarray inputs, while the main aperture need only have conventional phase shifters.

A number of subarraying feeds of this type are described by R. Tang in the publication *Survey of Time-Delay Beam Steering Techniques in Phased Array Antennas;* Proceedings of The 1970 Phased Array Antenna Symposium, Artech House, Inc. Dedham, MA pp 254–260. Null steering circuits are described in detail in the publication of D. J. Chapman, entitled *Adaptive Arrays and Sidelobe Cancellers; A Perspective,* Microwave Journal, August 1977, pp 43–46. These publications together represent and are typical of the state-of-the-art in this area.

Subarray antenna systems utilizing such state-of-the-art circuits are subject to the undesirable effects of illumination truncation at the edge of the array. This results in high sidelobe pattern and limitations on the control of individual nulls and the ability to null entire regions of the subarray pattern.

Consequently, to date there is no known wideband technique for scanning a low sidelobe subarray. Present techniques require subarraying from very narrow band subarrays or from subarrays that are limited to −20 to −25 dB sidelobes. Accordingly, there currently exists the need for techniques and system functions that will provide the ability to scan over wide spatial angles with wide bandwidths and low sidelobes and that will permit improved control of nulling at both the array and subarray levels. The present invention is directed toward satisfying that need.

SUMMARY OF THE INVENTION

Subarray antenna systems utilize a main array of radiating elements that is comprised of a number of subarrays. The subarrays are fed from an array of feed elements that in turn is controlled by a phased array circuit. Time delay controlled beam steering is accomplished by variable time delays in the phase array circuit inputs. The invention comprehends introducing an illumination intensity taper to the feed array output as a means for improving system performance. This is accomplished by inserting a variable attenuator and a variable phase shifter into each feed element. The taper can be configured (by manipulation of these elements) to provide selected nulling at either the feed or main array level. The taper also can be tailored to provide sidelobe suppression of the antenna radiation pattern. Nulling can be either deterministic or adaptive.

It is a principal object of the invention to provide a new and improved subarray antenna system.

It is another object of the invention to provide a subarray antenna system having the capability of scanning over wide spatial angles with wide bandwidth and low sidelobes.

It is another object of the invention to provide a subarray antenna system wherein nulls can be placed in the subarray pattern.

It is another object of the invention to provide a subarray antenna system capable of producing wide band nulling at the main array level.

It is another object of the invention to provide a subarray antenna system capable of controlling nulls at the main array level and at the subarray level simultaneously.

These together with other objects, features and advantages of the invention will become more readily apparent from the following detailed description taken in conjunction with the illustrative embodiments in the accompanying drawings.

DESCRIPTION OF THE DRAWINGS

FIG. 6 is a graph illustrating a uniformly illuminated edge subarray pattern;

FIG. 7 is a graph illustrating a uniformly illuminated central subarray pattern;

DETAILED DESCRIPTION OF THE PREFERRED EMBODIMENT

Figure 1:
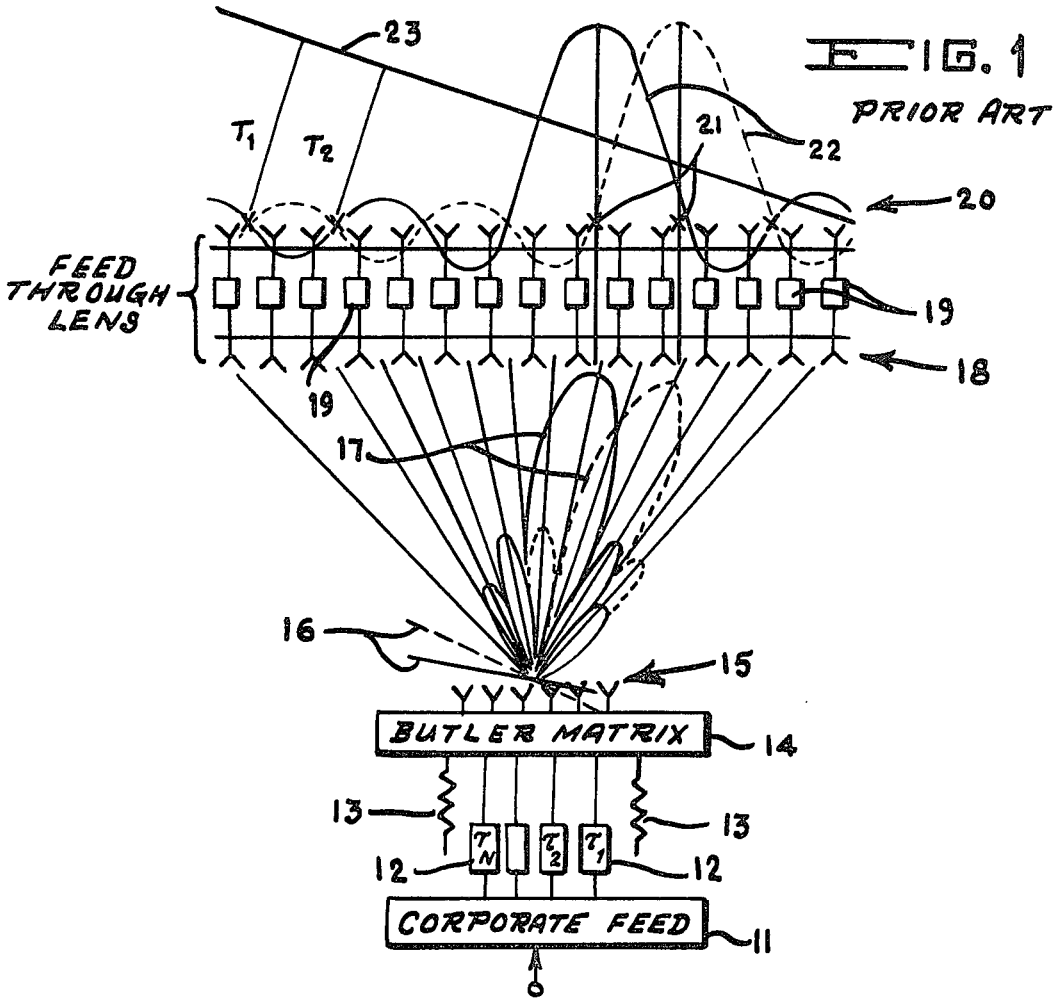
FIG. 1 PRIOR ART
FIG. 1 is a schematic illustration of a space fed subarray antenna system.

The invention comprehends tailoring the subarray pattern of a phased array antenna in order to make it less subject to the undesirable effects of illumination truncation at the edge of the array and to control individual nulls or to null entire regions of the subarray pattern. A subarray antenna system of the type to which the invention applies is illustrated schematically in FIG. 1. This is a space fed system and comprises corporate feed 11, time delays 12, matched loads 13, a Fourier transform feed circuit 14 (Butler or Blass matrix or multiple beam lens) feed array 15, pick up array 18, phase shifters 19 and radiating array 20. Phase distributions across the feed array for various subarray input terminals are illustrated by phase fronts 16. The illumination patterns 17 are shown as corresponding to the various subarray input terminals. Curves 22 are the amplitude distributions of subarrays across the radiating apertures and are shown to have phase centers 21. The radiated plane wavefront 23 is also shown.

Figure 2:
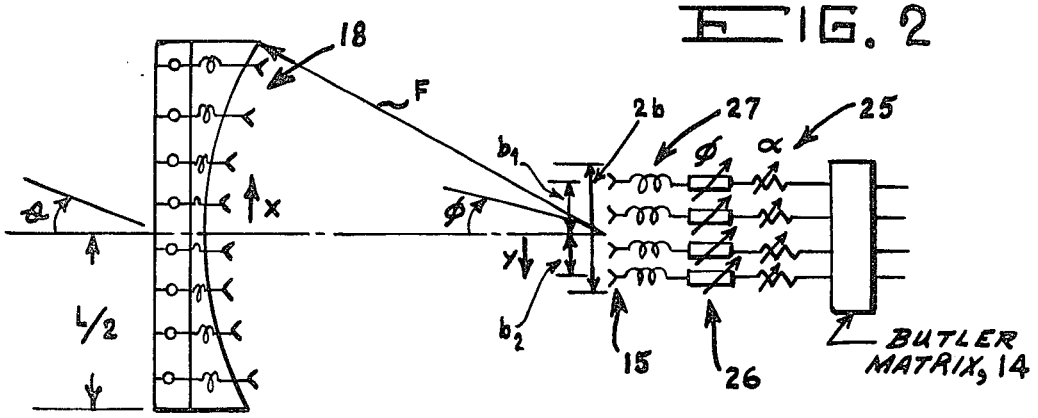
FIG. 2 is a schematic illustration of the subarray pattern control means of the invention as applied to a space fed subarray antenna system.

FIG. 2 illustrates one possible modification of the subarray antenna system of FIG. 1 that can accomplish the objectives of the invention. This modification comprises the insertion of variable attenuators 25 and/or phase shifters 26 into the feed circuits as shown. These controls are either deterministically or adaptively implemented as hereinafter described to effect a tapered illumination intensity across the feed apertures. Fixed delays 27 are provided for focal region correction.

Figure 3:
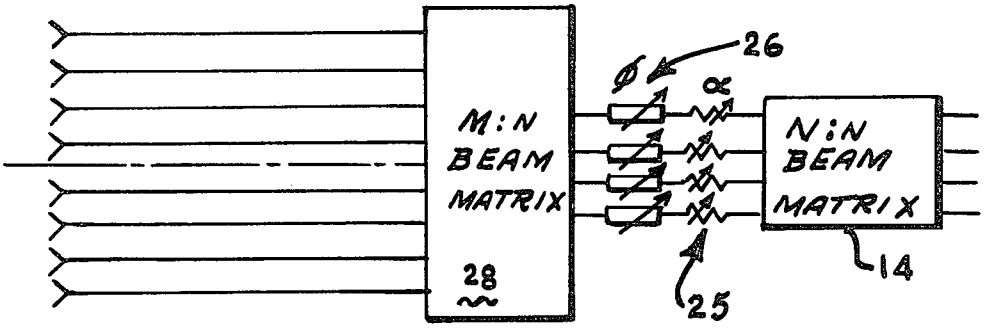
FIG. 3 is a schematic illustration of the subarray pattern control means of the invention as applied to a constrained feed subarray antenna system.

The techniques of the invention can also be employed in constrained subarray antenna system as illustrated by FIG. 3. In this embodiment a second M to N feed matrix 28 is employed and the signals are fed directly to the radiating elements in a conventional manner.

Figure 4:
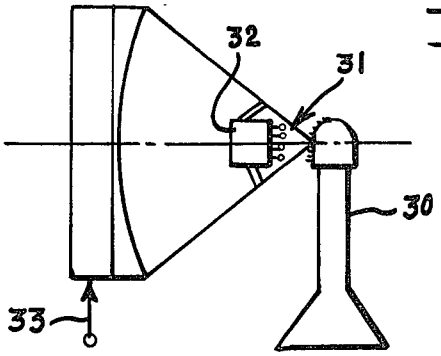
FIG. 4 is a schematic illustration of the subarray pattern control means of the invention applied to a mechanically positioned lens.

The circuitry and technique of the invention can also be used for an array without phase shifters in the array aperture. Such an embodiment is illustrated schematically in FIG. 4 and comprises azimuth and elevation positioner 30, feed and subarray control network 32, housing subarray ports 31, and equal path lens 33. Lens 33 in this arrangement is without phase steering.

Subarray antenna systems incorporating the subarray pattern control and null steering means of the invention are capable of: (a) scanning over wide spatial angles with wide bandwidth and low sidelobes; (b) placing nulls in the subarray pattern; (c) producing wide band nulling at the array level; and (d) controlling nulls at the array level and at the subarray level simultaneously. Low sidelobe scanning is provided by using time delay devices at the subarray input ports. The set of subarray input ports is time delay steered just as any conventional subarrayed antenna would be, and the near sidelobes are determined by the taper imposed across the set of subarray feeds (and hence the taper of subarray weightings across the main array). The phase shifters in the main array are set to the phase progression $(d/\lambda_o) \sin \theta_o$ between elements spaced "d" apart in order to place the subarray center at the scan point $(\theta_o)$ at frequency band center. The key feature of this geometry however, is that the taper across the feed array causes very low subarray sidelobes, and hence the main array grating lobes can be much lower than those of competing techniques.

The ability to place nulls in the subarray pattern is accomplished by adjusting the feed array taper to produce null fields at desired points on the feed array. Because of the dual transform action these nulls are also present in the subarray pattern. They can be fixed in position at a desired location while the array is scanned to some other point within the subarray pattern. With regard to the ability to produce wide band nulling at the array level it is noted that null formation at the array level is controlled by the time delay networks at the subarray input ports. Wide band nulling at this level can be produced only if all the various channel ports (subarray ports) have the same dispersion. The low sidelobes at the subarray illuminations (not the subarray patterns) present channel characteristics that are not affected by the edge of the array (truncation), and hence are all similar. Time delay processing can then produce nulling at the array level over relatively wider bandwidths than other techniques.

The ability to control nulls at the array level and at the subarray level simultaneously follows directly from the independence of the features described above. In particular, these nulls could also coincide to produce extremely deep nulls if desired.

Figure 5:
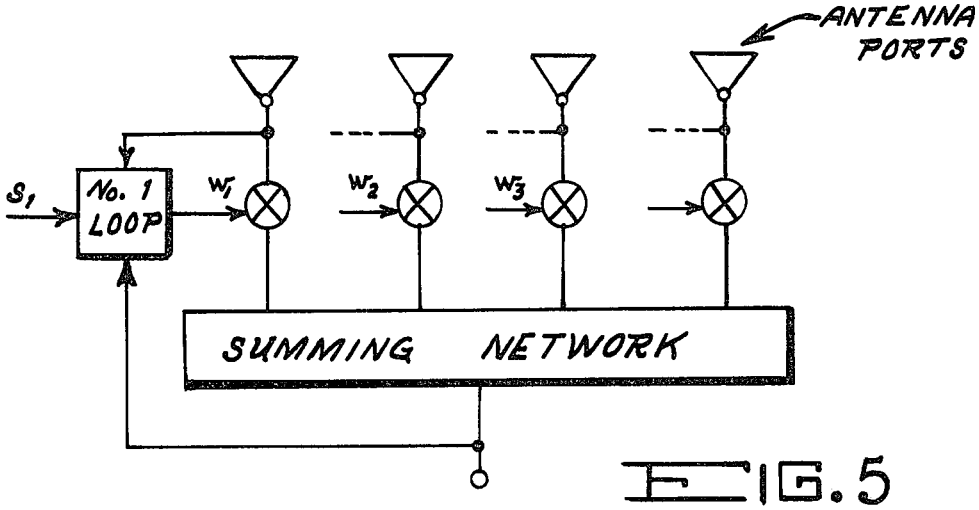
FIG. 5 PRIOR ART
FIG. 5 is a schematic of a generalized adaptive nulling network.

As indicated above, nulling of the subarray feeds can be accomplished either deterministically or adaptively. Specifically, the subarraying type of feed can be used to control antenna pattern nulls at the array level. Such null steering uses the same sort of circuitry as conventional array null steering and is described in a large number of recent journal articles. A good summary of this field of research is given in the article: *Adaptive Arrays and Sidelobe Cancellers; A Perspective*, by D. J. Chapman, referenced above. A generalized circuit for performing adaptive null steering is shown in FIG. 5. Chapman outlines three main approaches that typify most of the adaptive circuits; the sample matrix inversion technique, the correlation loop and the modified random search algorithm. The first method involves a digital solution of the optimization equation. The input variable is the direction of the scanned beam and solution of the equation maximizes signal to noise relative to the signal arriving from the main beam direction. The correlation loop processor employs some algorithm similar to the Howells-Applebaum or Widrow algorithms. In each of these systems a steering signal again contains the required main beam directional information. The system receives the desired signal plus noise, and the system identifies the undesired part of the received signal by correlation, and changes weights to minimize this undesired signal. The Widrow algorithm does not assume a known direction of arrival, but instead uses a pilot signal generated within the receiver that matches a signal from the transmitting source. The system forms a retrodirective beam in the direction of the received signal that correlates with the pilot signal, and forms nulls at the jammer sources. The third technique is the modified random search technique. Here again the main beam direction must be known, and the system changes weights according to a variety of random search routines, but ultimately converges in an iterative fashion by continually monitoring the residue (difference between desired and undesired signals).

These techniques are well established. In the case of a subarraying antenna the subarray input ports are merely the antenna terminals and the nulling is done at the array level. The nulling is adaptive in the sense that the circuitry continually adjusts for position changes in the noise distribution (jammer motion). Deterministic null steering is less frequently employed with arrays, and consists of solving the array equations to place nulls in the directions where jammers are known to be, but without using the jammer signals in the nulling process.

Null steering for conventional (not overlapped) subarrays could also be done by grouping elements into subarrays and nulling within the subarray patterns. Here again the procedure is not changed because each element uses an adaptive loop and the same algorithms apply. The subarray is treated as an array for the purposes of null steering, then the adapted subarrays are grouped together to form a main beam.

This invention presents means to control subarray patterns by amplitude (and phase) control at the subarray feed output ports; this can improve the quality of null steering control at the array level and can present an entirely new and superior means of null steering at the subarray level.

The advantage to array level null steering of subarray pattern control, as implemented in this invention is that by selecting a tapered subarray feed excitation the effects of subarray truncation are minimized. Each subarray pattern becomes very similar to every other subarray pattern and this has the advantage of producing an array distribution independent of frequency. For example, the adaptive circuits discussed in the Chapman reference usually use a single set of array element weights determined at some center frequency, and so achieve a degree of bandwidth only if all elements have the same frequency characteristics. If the edge elements of the array have different frequency dependence than the center elements, than the net array illumination effectively changes with frequency. FIGS. 6 and 7 show two subarray patterns 35, 36 in an array of 8-subarrays for a uniformly illuminated subarray pattern. Note that the ripples in the patterns for the centrally located and edge subarrays are substantially different, and since the position of the main beam corresponds to different angular regions of the subarray pattern as the frequency is changed, then the effective array illumination is changed with frequency in proportion to the change in subarray patterns. This effect can be minimized using multiple sets of weights on a tapped delay line, but cost and practicality place limits on the utility of this approach.

Figure 8:
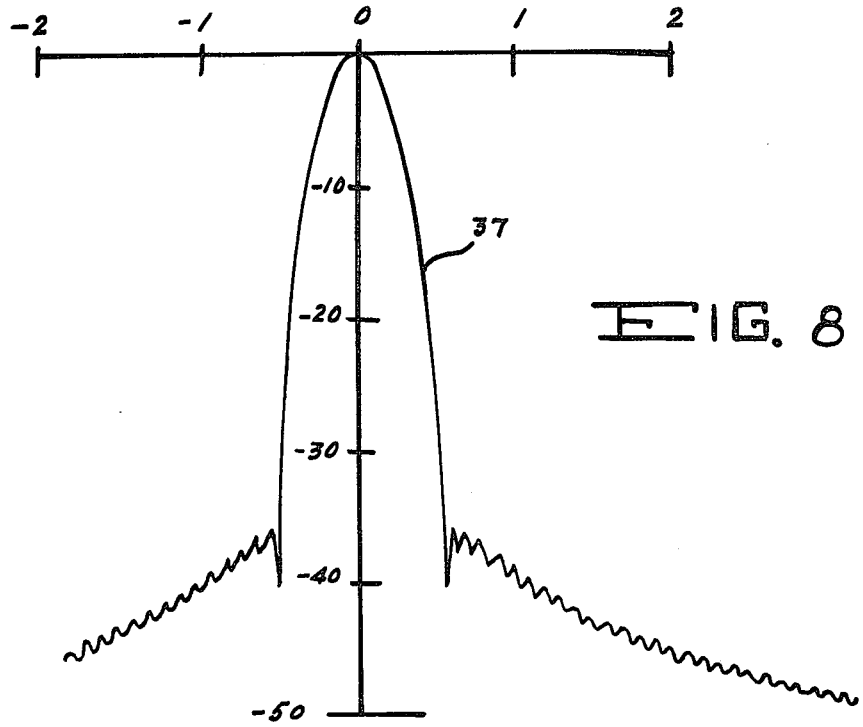
FIG. 8 is a graph illustrating a tapered illumination edge subarray pattern.
Figure 9:
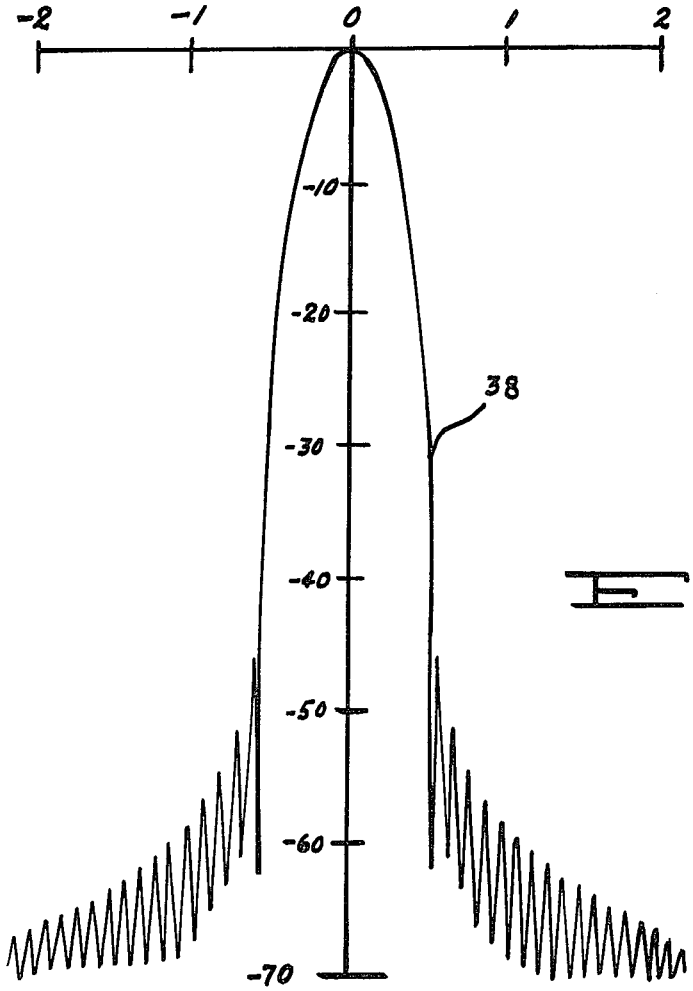
FIG. 9 is a graph illustrating a tapered illumination central subarray pattern.

Alternatively, subarray patterns 37, 38 of FIGS. 8 and 9 show that the central and edge subarrays have nearly coincident subarray patterns when subarray feed taper is used to minimize truncation effects in the manner indicated in this invention. This equality of subarray patterns assures that the array illumination selected for proper null formation at the central frequency will also form nulls at the appropriate angular location at other frequencies throughout the passband. In this manner the technique will produce substantially wider band null formation than available without subarray pattern control.

Subarray nulls formed by the conventional means described above, and implemented using the circuitry commonly used for array null formation has limited bandwidth because of the subarray squint. Broadband nulls at the subarray level must be wide in their angular extent in order to produce deep nulls at given angles independent of subarray squint. Such wide nulls, or troughs, can be produced by means of the apparatus of this invention by making a wide nulled region at the subarray feed output. This should be done using a tapered illumination in order to avoid null filling through the effects of truncation. One solution is to use several tapered illuminations with the trough between them, and another is to narrow the illumination function at the feed output ports so that it is only wide enough to pass the frequency spectrum, of the main beam at the desired angle.

Figure 10:
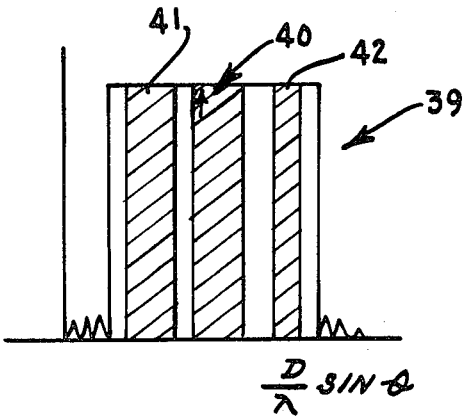
FIG. 10 illustrates a uniformly illuminated flat topped subarray pattern.

FIG. 10 shows a flat topped subarray pattern 39 with crosshatched areas indicating the angular regions of the subarray occupied by the desired signal 40 and wideband interference signals 41, 42.

Figure 11:
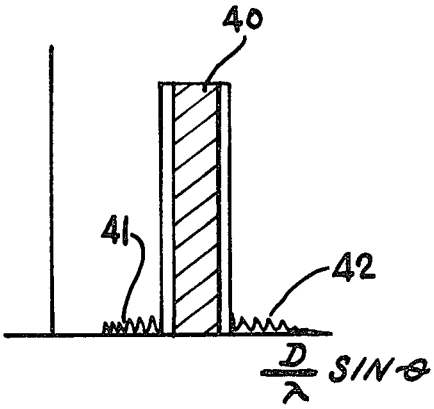
FIG. 11 illustrates the subarray pattern of FIG. 10 narrowed by narrowing the feed illumination.

FIG. 11 shows that narrowing the pattern (by using a narrowed, tapered feed illumination) can result in substantial suppression of the interfering signals over wide frequency ranges.

Bandwidth constraints for this circuit are the following: If the output of the subarray is tapered so that the only nonzero excitation is confined to the region $-b_1 \leqq y \leqq b_2$, then in the absence of truncation effects the subarray pattern exists within the boundaries of the expression below for the subarraying feed configuration of FIG. 2.

$$\frac{-b_2}{2b} \leqq \frac{D}{\lambda} \sin\theta - \frac{D}{\lambda_o} \sin\theta_o \leqq \frac{b_1}{2b} \tag{1}$$

with no constraints, $b_1 = b_2 = b$ and the system bandwidth (for an idealized flat topped subarray pattern) is given by:

$$\text{Bandwidth} = \frac{f\max - f\min}{fo} = \frac{1}{(D/\lambda_o)\sin\theta_o} \tag{2}$$

If an interfering signal radiates at an angle $\theta j$ (in this case for $\theta j > \theta_o$), operating over a frequency range bounded by the lower frequency with wavelength $\lambda j_{max}$ and the upper frequency with wavelength $\lambda j_{min}$, then the system upper frequency is bounded by the condition $$\frac{D}{\lambda\min} \sin\theta_o \leqq \frac{D}{\lambda j\max} \sin\theta_j \tag{3}$$

This condition serves to define the boundaries of the excited port of the feed by means of the conditions:

At upper freq:

$$(D/\lambda_{min}) \sin\theta_o - (D/\lambda_o)\sin\theta_o = \frac{b_1}{2b} \tag{4}$$

At lower freq:

$$D/\lambda_{max} \sin\theta_o - D/\lambda_o \sin\theta_o = \frac{-b_2}{2_b} \tag{5}$$

which result in the final relation for bandwidth:

$$BW = \frac{(b_2 + b_1)}{2b} \cdot \frac{1}{D/\lambda_o \sin\theta_o} \tag{6}$$

which reduces to equation 2 for $b_1 = b_2 = b$.

The dimension $b_1$ is chosen using equations 3 and 4 above, to obtain:

$$(D/\lambda_{jmax}) \sin\theta j - (D/\lambda_o) \sin\theta_o \geqq \frac{b_1}{2b} \tag{7}$$

If the frequency $fj_{min}$ is such that $b_1$ is restricted to being less than b then the bandwidth is less then the maximum available (Eq. 2). The bandwidth reduction is achieved by retaining the same lower frequency limit and reducing the upper frequency limit in accordance with equation 4.

Although this analysis has been carried out assuming idealized square tapped subarray patterns, in practice it may be advantageous to use tapered subarray illuminations to reduce truncation effects. In this case the bandwidth will be reduced in proportion to the subarray taper.

Figure 12:
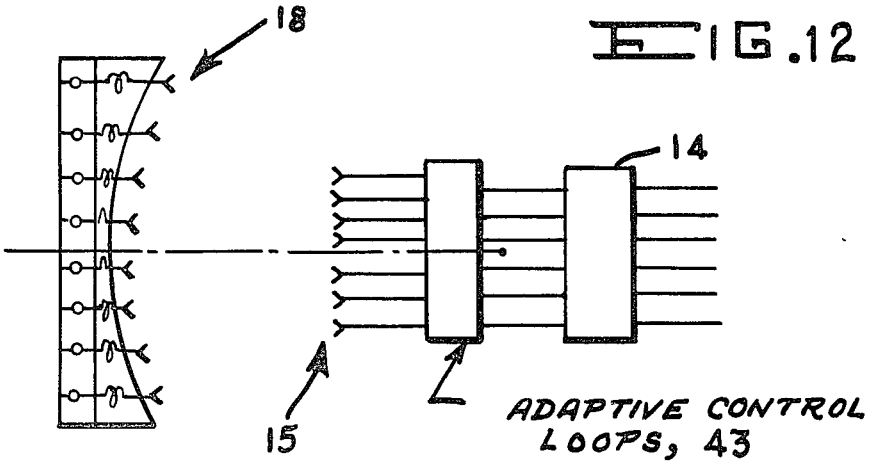
FIG. 12 illustrates the subarray pattern control means of the invention including an adaptive control loop.

Such subarray pattern control as required to narrow the subarray pattern and avoid interfering signals, can be implemented or either adaptively or deterministically. The deterministic solution is obtained directly from equations 6 and 7 based upon knowledge of the position and bandwidth of the interference and desired signals. The adaptive solution can be obtained in a number of ways and using a variety of adaptive circuits, both digital and analog, but would be based upon some knowledge of the bandwidth and angular location of the desired signal. This information can be used to compare with sampled signals at the front of the subarray feed, and to suppress the signal passing through certain sections of the feed by properly weighting the ports at the output of the subarray feed as shown schematically by adaptive central loops 43 in FIG. 12. The weighting functions can be derived from rêsidue at the subarray output ports themselves, with digital or analog information, or from the received signals at output ports themselves, with digital or analog information, or from the received signals at the subarray input ports. The main feature of this invention is that the weighting control is done at the location shown in the figure.

An additional feature of this invention is that it allows null placement in the direction of any jammer or interfering source unless it occupies the same spectrum limits and angular location as the desired sources.

By way of example, the radiation characteristics of the system will be developed for a basic configuration using a one-dimensional circular lens fixed time delays at the hybrid matrix output for subarray collimation. The essential elements of this configuration are illustrated in FIG. 2. The main array has phase shifters to produce a phase tilt that scans the subarray patterns. The feed is a Fourier transformer in the form of a hybrid matrix or multiple beam lens, but for the purposes of this analysis a multiple beam lens with true time delay will be assumed. In addition, the feed array and the lens faces will be modeled as continuous apertures, and the projection factor cos will be suppressed for convenience.

The purpose of the multiple beam feed is to form a group of N-equally spaced illumination functions across the main array, one corresponding to each beam of the multiple beam feed. Assuming an even number of subarray input ports to the feed matrix, the geometry is selected so that after proper adjustments for collimation each beam (p) of the feed radiates to produce an illumination g ($\eta$-q) at the input to the phase shifters at the radiating face of the circular lens, where $$\eta = x/D$$

and $$q = p - \tfrac{1}{2}$$

The phase shifters at the front of the lens are set to form a progressive phase tilt that is a discrete sampling of the continuous function.

$$\left(\frac{x}{\lambda_o}\, 2\, \eta \sin \theta_o\right)$$

The radiation pattern corresponding to each of the phase shifted subarray illuminations is called the subarray pattern and is given by the following expression (after removing the relative phase displacement $qD/\theta_o \sin \theta_o$ at the p-th subarray)

$$f(p) = \frac{1}{K} - \int_{l/2}^{l/2} e^{j2\pi(\eta - q)\beta_a}\, g\,(\eta\, q)\, d\,\eta$$

for $\beta_a = RS + S_0$ ; $l = L/D$ $S = (D/\lambda_o) \sin\theta$ ; $S_o = (D/\lambda_o) \sin\theta_o$ $R = \lambda_o/\lambda$ and $K$ = normalizing factor Adding time delay elements at the input of each subarray port to provide time delay corresponding to the distance Dq sin $\theta_c$ for collimation at some angle $\theta_c$ (which may or may not correspond to the angle of the center frequency subarray beam center $\theta_o$) results in radiation characteristics for the complete array as given by:

$$F(s) = \sum_{\frac{-N}{2}+1}^{\frac{N}{2}} I_p f(p) e^{j2\pi qR\,(s - s_c)} \tag{9}$$

The array pattern is the weighted sum of the subarray patterns. If the spacing D is more than half a wavelength the resulting pattern will have grating lobes at angles $\theta$ given by:

$$\sin\theta = \sin\theta_c + n(\lambda/D) \tag{10}$$

In the limiting case when all subarray patterns are the same the array radiation pattern is the product of the subarray pattern and the array factor, so the grating lobe amplitude is at the level of the subarray sidelobe.

Thus the tapered distribution $I_p$ controls the level of the near sidelobes (within the subarray pattern), and the subarray sidelobes control the level of the far sidelobes because these are the grating lobes of the array factor.

The array patterns F(s) is time-delay scanned and does not squint (the peak is always at $\sin\theta = \sin\theta_c$), but the subarray pattern is a function of $(RS - S_o)$ and squints with frequency. For this reason the previous developments have emphasized the formation of pulse shaped subarray patterns to provide grating lobe suppression over a given band of frequencies. Such patterns are formed by an orthogonal hybrid network or lens with equal amplitude output coefficients. A signal applied to one of the input ports excites a set of uniformally illuminated output signals corresponding to one of the multiple beams. The feed array excites the main array with an illumination given approximately by $$g(\eta - q) = \sin \pi(\eta - q)/\pi(\eta - q) \tag{11}$$

If l were infinite this excitation would produce a flat topped pattern f(p) constant for $|\beta_a| = |RS - S_o| < \frac{1}{2}$ and zero for $\beta_a$ outside of that region. This pattern provides perfect grating lobe suppression for a very large array over a frequency bandwidth of approximately $1/S_o$. Unfortunately, the truncation of this illumination function causes relatively high subarray sidelobes and hence can result in unacceptable grating lobe levels for certain array sizes and illumination parameters Ip.

FIGS. 6 and 7 show typical subarray and array patterns for an array 10 subarrays wide (l=10) with the central 8 subarrays active. Since the subarray pattern is a function of the angular difference parameter $\beta_a = (D/\lambda) \sin\theta - (D/\lambda_o) \sin\theta_o$ and not a function of the scan angle $\sin\theta_o$ alone, all figures have been plotted with $\theta_0$ equal to zero, but apply equally well to scanned or unscanned subarray patterns with the cos $\theta$ projection factor introduced appropriately.

As an example of an alternate approach, the curves shown in FIGS. 8 and 9 correspond to a feed taper given by the function $c+\cos^2(\eta y/2b)$ for $c=0.071$. This is indeed a severe example of feed amplitude taper, and it is used here for illustrative purposes only. The subarray illumination for this familiar function has the form:

$$g(\eta - q) = \frac{\sin\pi(\eta - q)}{\pi(\eta - q)}\left[c + \tfrac{1}{2}\frac{1}{(1-(\eta - q)^2)}\right] \tag{12}$$

This illumination has such low sidelobes that its radiation pattern is essentially unaltered by truncation and has the same form as the feed taper (in the angular coordinate "S") because both the feed network illumination and the radiation pattern are obtained by taking the Fourier Transform of the subarray illumination. FIGS. 8 and 9 show this subarray pattern to have extremely low sidelobes but inferior bandpass characteristics as compared with orthogonal subarrays. In addition, the non-orthogonal nature of the feed distribution will introduce significant losses in the multiple beam network, and so system efficiency may dictate the use of linear amplifiers at the subarray feed. However, the use of this distribution illustrates the possibility of producing excellent grating lobe control with low sidelobe subarray patterns even for truncated subarray illuminations.

Moreover, within the angular passband, the subarray radiation patterns are so similar across the array that wideband null steering is possible at the array level by using algorithms for null steering at the array terminals (subarray ports).

In accordance with the teachings of the invention, a successful technique for forming wide band subarray nulls follows from the use of one or several tapered illuminations instead of the discontinuous illumination above. The chosen illumination is:

$$\begin{aligned} a(y) &= \left[c + \cos^2\frac{\pi(y - y_1)}{2\Delta_1}\right] y_1 - \Delta_1 < y < y_1 + \Delta_1. \\ &= \left[c + \cos^2\frac{\pi(y - y_2)}{2\Delta_2}\right] y_2 - \Delta_2 < y < y_2 + \Delta_2. \end{aligned} \tag{13}$$

and the resulting subarray illumination has the form $$\begin{aligned} g(\eta - q) = {} & \frac{\Delta_1}{b} e^{j\pi y_1(\eta - q)} \frac{\sin\pi[(\eta - q)\Delta_1/b]}{\pi\frac{\Delta_1}{b}(\eta - q)} \cdot \left[c + \tfrac{1}{2}\frac{1}{(1-\frac{\Delta_1}{b})^2(\eta - q)^2}\right] \\ & + \frac{\Delta_2}{b} e^{j\pi y_2(\eta - q)} \frac{(\sin\pi[(\eta - q)\Delta_2/b]}{\frac{\Delta_2}{b}\pi(\eta - q)} \cdot \left[c + \tfrac{1}{2}\frac{1}{1-(\frac{\Delta_2}{b})^2(\eta - q)^2}\right] \end{aligned} \tag{14}$$

Figure 15:
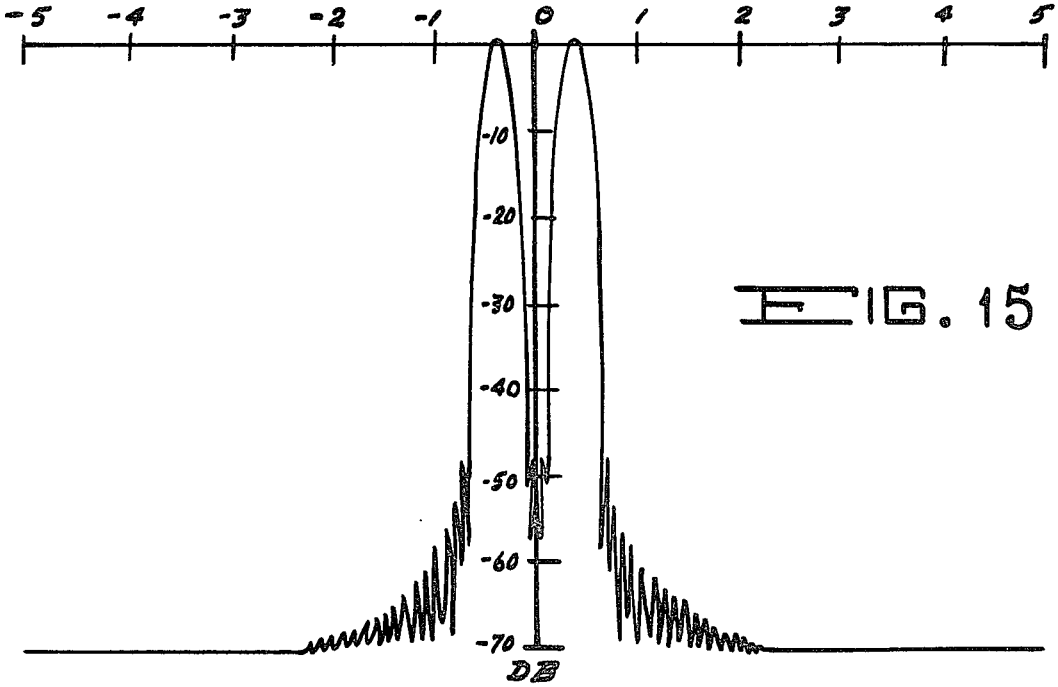
FIG. 13, 14 and 15 are graphs showing subarray patterns for a selected feed illumination.
Figure 13:
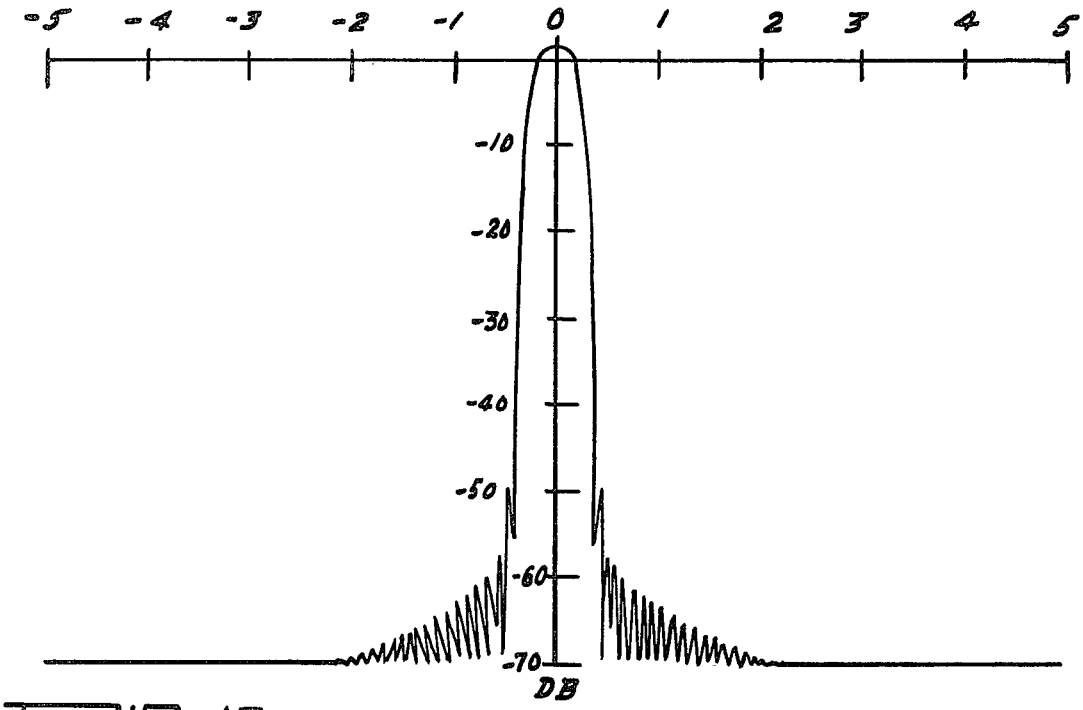
Figure 14:
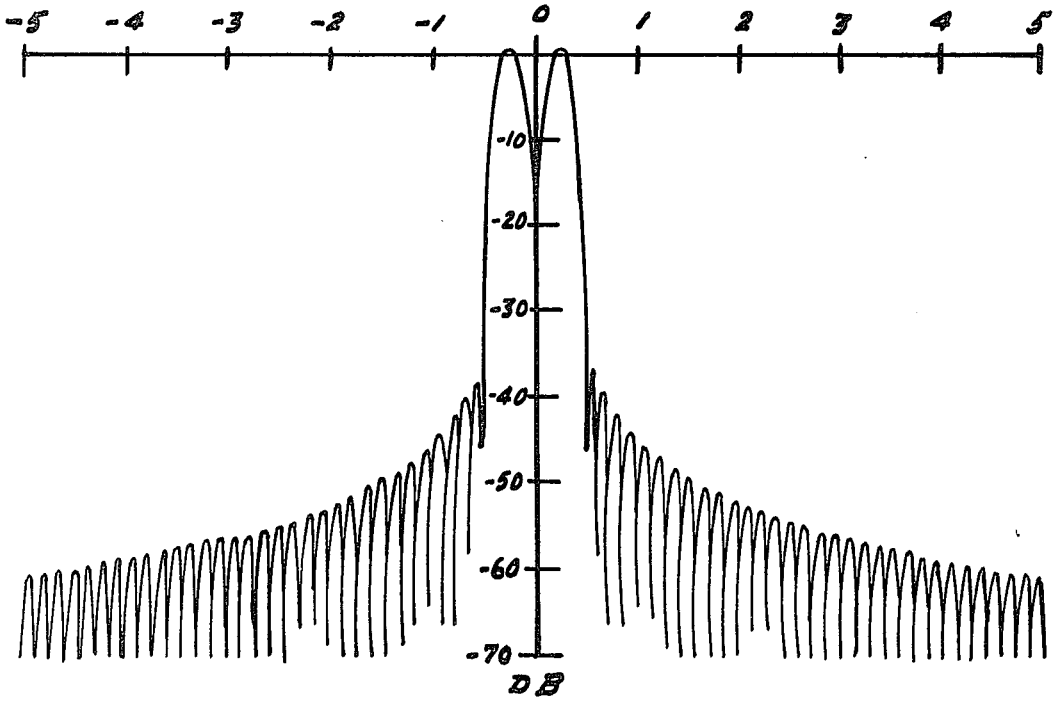

FIGS. 13 through 15 show the subarray patterns for this illumination with $$\frac{(\Delta_1)}{b} = \frac{(\Delta_2)}{b} = 0.5;\ c = 0.71$$

$L = 10$ and $$\frac{y_1}{b} = \frac{-y_2}{b} = 0.25,\ 0.5 \text{ and } 0.75$$

These curves show the resulting subarray pattern can be varied from a nearly flat-topped pattern to one with a wide trough between two peaks. FIG. 13 suggests immediately that far greater bandwidth can be obtained from a flat-topped illumination with tapered edges than can be achieved with a $\cos^2$ on a pedestal distribution. As the spacing between the two illumination functions is increased (to $y1/b=0.5$ and 0.75) a null is formed over a frequency range that is proportional to the width of the trough, and so the ability to control such a deep, broad trough aids substantially in wide band null control. Since it is possible to keep the subarray null fixed in position while scanning the beam over a limited sector. Alternatively, full scan capability is maintained by scanning the main beam and the subarray null.

A most useful means of jammer suppression with such a system would simply be to narrow the subarray pattern using a tapered illumination like one of the functions in equation 9, or some other distribution that uses only a part of the feed array, then to use the steep skirts of the subarray pattern to discriminate against the unwanted noise signal.

In all such cases the array band width is also substantially narrowed because subarray squint places the mainbeam in the trough for some frequencies, but the net effect is that a relatively wide band null can be maintained through subarray control alone, and by the use of only relatively few controls.

While the invention has been described in one presently preferred embodiment, it is understood that the words which have been used are words of description rather than words of limitation and that changes within the purview of the appended claims may be made without departing from the scope and spirit of the invention in its broader aspects.

What is claimed is:

1. In a subarray antenna system having an array of radiation elements, a Fourier transform feed circuit and an array of feed elements fed by said Fourier transform feed circuit and feeding said array of radiation elements, the improvement residing in a subarray pattern control means, said subarray pattern control means comprising illumination intensity control means controlling the outputs of said feed elements, said illumination intensity control means comprising a variable attenuator controlling each feed element, said variable attenuators in combination effecting a tapered illumination intensity distribution at the output of said array of feed elements.

2. In a subarray antenna system a subarray pattern control means as defined in claim 1 wherein said tapered illumination intensity distribution is configured to effect sidelobe suppression of the antenna radiation pattern.

3. In a subarray antenna system a subarray pattern control means as defined in claim 1 wherein said tapered illumination intensity distribution is configured to effect selected nulling in the feed pattern of said array of feed elements.

4. In a subarray antenna system a subarray pattern control means as defined in claim 1 wherein said tapered illumination intensity distribution is configured to equalize all subarray patterns to effect wideband null steering at the array level.

5. In a subarray antenna system a subarray pattern control means as defined in claim 3 including an adaptive nulling circuit actuating said illumination intensity control means.

6. In a subarray antenna system a subarray pattern control means as defined in claim 5 including a variable phase shift means controlling each said feed element.

7. In a subarray antenna system a subarray pattern control means as defined in claim 5 wherein said subarray antenna system is a space fed system.

8. In a subarray antenna system a subarray pattern control means as defined in claim 6 wherein said subarray antenna system is a constrained system and includes a second Fourier transform feed circuit fed by said array of feed elements and feeding said array of radiating elements.

9. In a subarray antenna system a subarray pattern control means as defined in claim 7 wherein said Fourier transform feed circuit is a Butler matrix.

* * * * *